United States Patent [19]

Brezosky

[11] 4,441,770

[45] Apr. 10, 1984

[54] APPLIANCE ANTI-TIP DEVICE

[75] Inventor: Bernard J. Brezosky, Louisville, Ky.

[73] Assignee: General Electric Company, Louisville, Ky.

[21] Appl. No.: 409,746

[22] Filed: Aug. 19, 1982

[51] Int. Cl.[3] ..... A47B 81/02

[52] U.S. Cl. ..... 312/276; 312/271; 312/253

[58] Field of Search ..... 312/271, 276, 311, 319, 312/273, 253

[56] References Cited

U.S. PATENT DOCUMENTS

| | | | |
|---|---|---|---|
| 3,150,904 | 9/1964 | Kendt et al. | 312/276 |
| 3,150,905 | 9/1964 | Payton et al. | 312/276 |
| 3,322,480 | 5/1967 | Barnstead et al. | 312/276 |
| 3,393,950 | 7/1968 | Dutcher et al. | 312/276 |
| 3,738,727 | 6/1973 | Race et al. | 312/276 |
| 3,820,866 | 6/1974 | Kaldenberg | 312/276 |
| 3,881,793 | 5/1975 | Anderson | 312/276 X |
| 3,912,350 | 10/1975 | Gurubatham | 312/276 |

*Primary Examiner*—James T. McCall
*Assistant Examiner*—Joseph Falk
*Attorney, Agent, or Firm*—Frank P. Giacalone; Radford M. Reams

[57] ABSTRACT

A freestanding appliance cabinet of the type having a door hinged to swing outwardly to provide access to the inside of the cabinet has an anti-tip member supported within the cabinet for movement of the cabinet to a tip-preventing position. The anti-tip member is interconnected with the door so that it is moved outwardly to its tip-preventing position when the door is open. The anti-tip member is adapted to provide support to the cabinet whereby tipping of the cabinet in a forwardly direction in response to force exerted downwardly on the open door surface is prevented. The anti-tip member has means operable to lock the member to the cabinet in the event that a tipping force is exerted on some part of the cabinet other than the door to further prevent tilting of the cabinet.

2 Claims, 5 Drawing Figures

APPLIANCE ANTI-TIP DEVICE

BACKGROUND OF THE INVENTION

In certain cabinet structures, such as freestanding dishwasher cabinet structures, the closure means is pivotally mounted on the front of the cabinet at the bottom of a front opening of the cabinet through which the dishes to be washed are delivered into and removed from the interior dishwashing space. The closure means, or door, is arranged to be pivoted from a closed position across the opening to an open position extending generally horizontally forwardly from the cabinet. The racks in which the dishes are placed conventionally are arranged to be moved forwardly through the opening for accessibility thereto. In moving forwardly, the lower rack is conventionally carried on the forwardly extending door. Downward forces on the forwardly disposed racks and door, such as by placing articles to be washed in the rack by the user bearing downwardly on the racks may cause the entire cabinet assembly to tip forwardly. The problem of tip-over could be overcome by securing the appliance to the floor or other solid structure; however, there are many occasions when it is either impossible or undesirable to do so. Tip-over could also be minimized by extending outrigging from the cabinet; however, this would result in excessive consumption of floor space. It, therefore, would be desirable to provide, in a freestanding cabinet having a door in its sidewall, anti-tip means to prevent tip-over of the cabinet.

U.S. Pat. No. 3,150,904-Kendt et al, assigned to the General Electric Company, the assignee of the present invention, discloses a pair of forwardly and downwardly directed outboard arms which are extensible to a point forward of the cabinet when the door is open to prevent tipping of the cabinet. U.S. Pat. No. 3,738,727-Race et al, assigned to the General Electric Company, the assignee of the present invention, discloses an anti-tip system that prevents tipping of the cabinet in response to the downward movement of the door from its open position and in response to the tilting forward of the cabinet. The present invention is an improvement over U.S. Pat. No. 3,738,727 in that once installed on any machine the active parts of the system will interact to prevent tip-over of the cabinet without adjustable tolerance requirements between the cabinet and the anti-tip structure.

It is, therefore, an object of the present invention to provide an anti-tilt system that once assembled relative to the cabinet no other adjustments are necessary between the anti-tilt arm and its supporting cabinet.

SUMMARY OF THE INVENTION

An anti-tip system for a freestanding cabinet adapted to be self-supporting on a floor surface. The dishwasher has an access opening and an access door hinged about a horizontal axis for movement between a closed position and a fully open position where it is supported in a substantially horizontal position by a support means.

The support means comprises an anti-tip member carried by the cabinet in a manner that allows movement of the member from a retracted position to an extended tip-preventing position. The anti-tip member includes a stop arm having an end connected to the access door so as to move the anti-tip arm between its retracted and extended tip-preventing position. The anti-tip member also includes an anti-tip portion extending from the front of the cabinet in the door open position to a location adjacent the floor and outward of the cabinet. Located on the stop arm is a stop surface oriented perpendicular to the line of travel of the first portion of the anti-trip arm. The stop surface engages a mating indexing surface secured relative to the cabinet for positioning the door in its horizontal open position and to prevent tipping of said cabinet, in response to an incident of the cabinet tipping through movement of the door downwardly from its open position. Also located on the stop arm is a locking means that engages the indexing surface on the cabinet. The engagement of the locking means with the indexing surface maintains the anti-tip portion against the floor in response to an incident of the cabinet tipping through movement of the cabinet. The locking means is arranged so that it is automatically released from the indexing surface when the access door is closed.

DESCRIPTION OF THE PREFERRED EMBODIMENT

Figure 1:
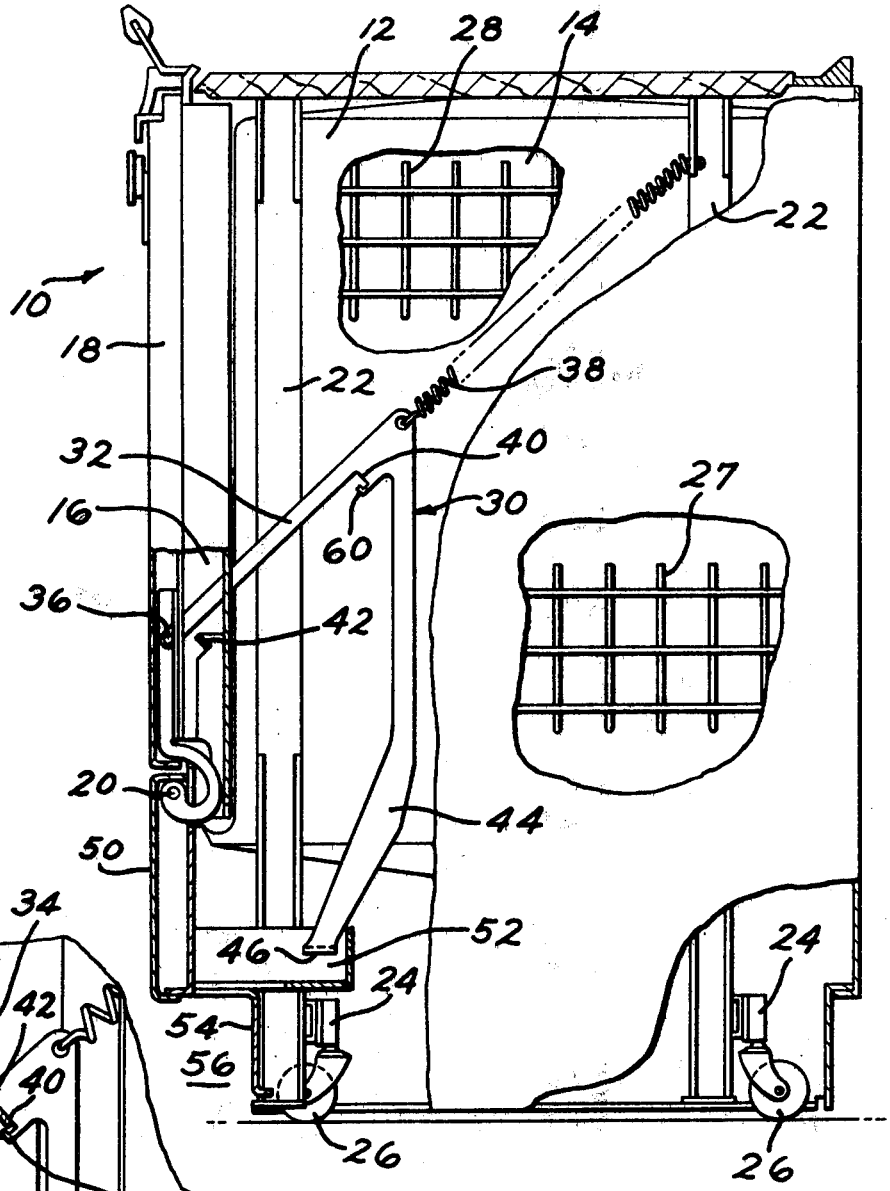
FIG. 1 is an elevational view of a dishwasher cabinet having the side wall thereof cut away to reveal internal components and particularly the structural arrangement of the preferred embodiment of the present invention.

Referring now to the drawings, and particularly to FIG. 1, there is illustrated a portable dishwasher 10 having an outer cabinet 12 that surrounds a wash chamber 14. The wash chamber has a forward access opening 16 covered by a vertically disposed closure member or door 18. The door 18 is provided with a hinge means 20 at its lower edge to facilitate its being opened from a closed position shown in FIG. 1 to the open position shown in FIG. 2. The cabinet structure is stabilized and supported by means of frame members such as spaced-apart, vertically-oriented channel bars 22. Such channel bars are used on each side of the cabinet to support the overall structure and suspend the wash chamber 14 and the components attached thereto within the cabinet. At the lower end of each channel bar 22 is a caster 24. Each caster 24 has a roller 26 contacting the floor surface therebeneath whereby the dishwasher 10 can be manually moved over the floor surface.

Figure 2:
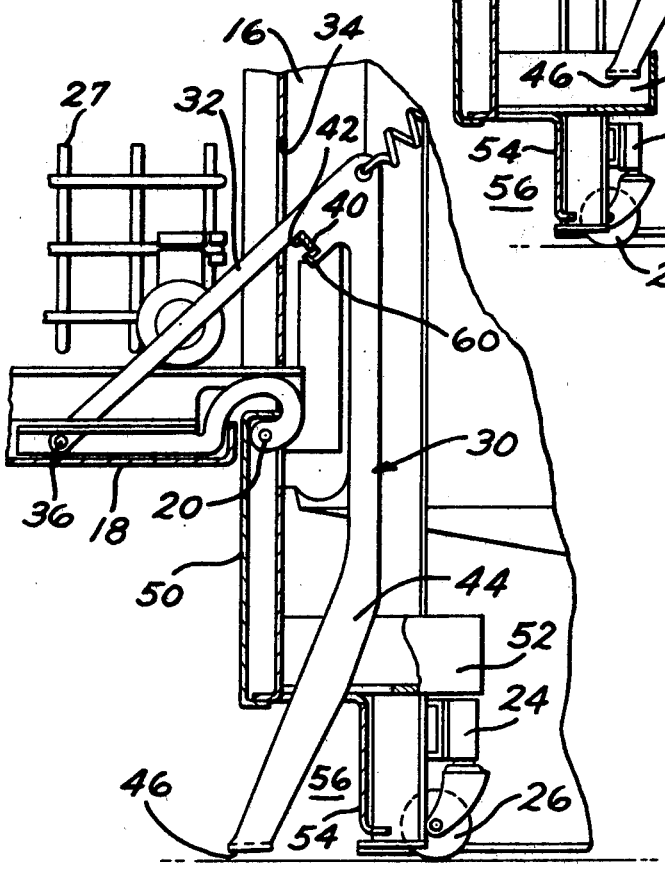
FIG. 2 is a fragmentary elevational view showing the lower front corner of the cabinet of FIG. 1 and showing the cabinet door in its open position.
Figures 3, 4, 5:
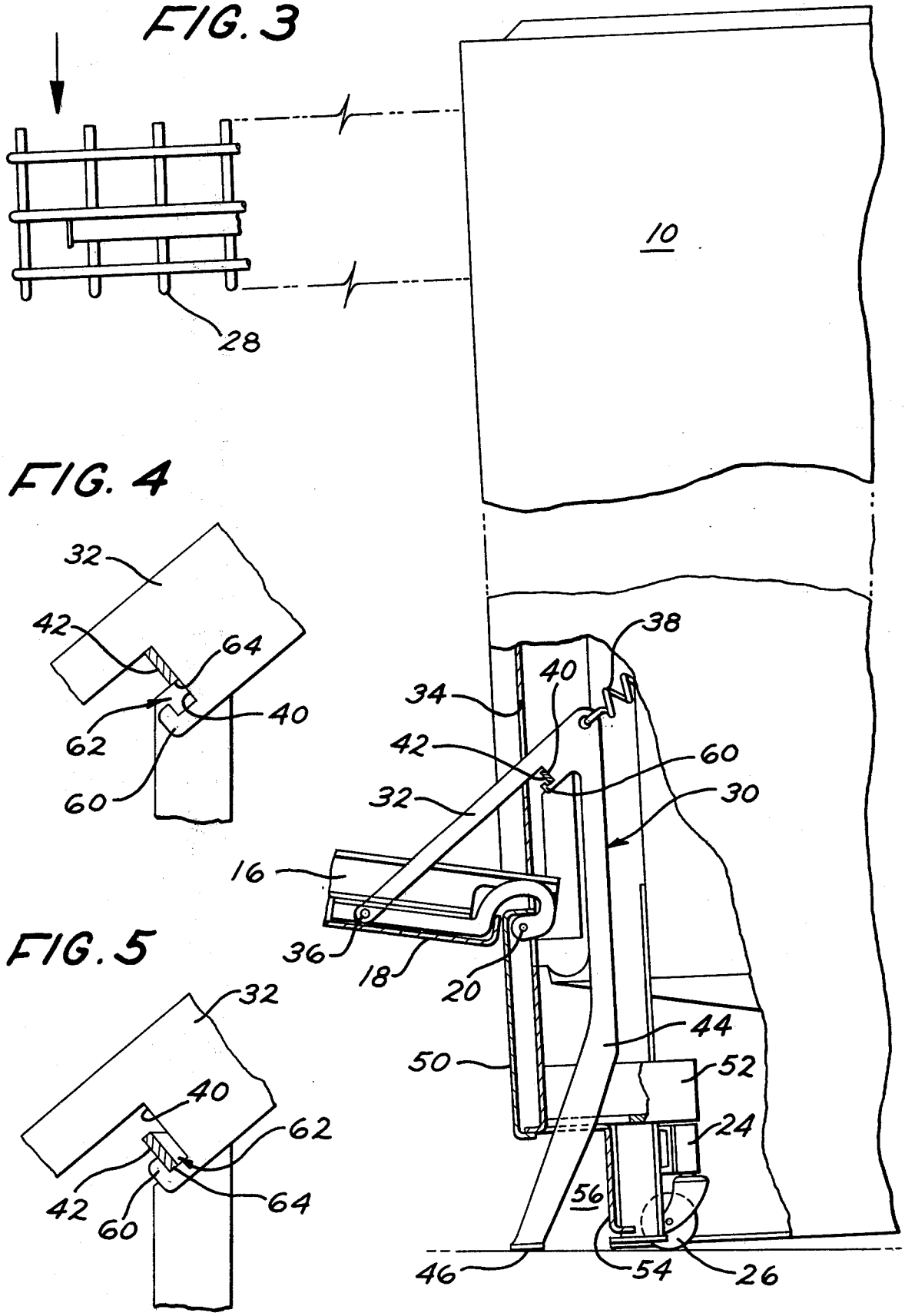
FIG. 3 is an enlarged fragmentary elevational view similar to FIG. 2 showing a re-orientation of the structure in accordance with the operation of the present invention.
FIG. 4 is an enlarged fragmentary view showing structural details of the anti-tip structure of the present invention.
FIG. 5 is a view similar to FIG. 4 showing the anti-tip structure in a locked position.

Referring to FIG. 2, with the access door 18 pivoted downwardly to its open and substantially horizontal position the appliance may have a tendency to tip towards the door if a sufficient downward force is applied to the door. This can happen, of course, when articles are placed in the lower rack 27 when it is positioned on the door as shown in FIGS. 2 and 3 during loading or unloading of the appliance. The appliance may also tip forward if a sufficient downward force were applied to the upper rack 28 during its loading or unloading. To this end, by the present invention means are provided to prevent the cabinet from tipping over during its loading or unloading. The present anti-tipping system is an improvement over the system disclosed in U.S. Pat. No. 3,728,727-Race et al, assigned to General Electric Company, the assignee of the present invention.

In the drawings, the apparatus of the anti-tip mechanism on only one side of the appliance is illustrated; however, it should be understood that a similar structure will be provided at the opposite side of the cabinet. As shown in the drawing, an anti-tip member 30 includes a stop arm or portion 32 adapted to slide through an opening 34 provided therefor in the cabinet. The end of stop arm 32 extending through opening 34 is pivotally secured at 36 to the door 18. The inner end of the member 30 is connected to one end of a biasing spring 38. The other end of spring 38 is attached to the upper portion of the rearward channel bar 22. The stop arm 32 of anti-tip arm 30 and spring 38 form a substantially straight line. A stop member 40 is provided at an intermediate point along the stop arm 32. The surface of stop member 40 is dimensioned to contact an indexing stop or member 42 secured relative to the cabinet. The indexing member 42 provides a surface that is engaged by the surface of stop member 40. The mating of surface areas of stop member 40 and indexing member 42 limit outward movement of portion 32 and, therefore, position door 18 in its horizontal open position, as shown in FIGS. 2 and 3.

Extending downwardly from the inner end of the anti-tip arm 30 and integrally attached thereto is an anti-tip portion 44. The portion 44 has a canted shape somewhat in the form of a dog leg and is adapted to move forwardly and downwardly in unison with movement of the arm 32 imparted by the pivoting movement of door 18. The portion 44 is adapted to move outwardly from the position shown in FIG. 1 to the position shown in FIG. 2 whereby it is in a position to preventing upsetting of the dishwasher in a forward direction, as will be described hereinafter. The portion 44 moves through the bottom front or downwardly facing side of the cabinet. The end 46 of portion 44 in effect provides a foot that, in its downward and outward position, extends forward of the cabinet. In this outward position, foot 46 is adapted to engage the floor surface in the event the cabinet tips forward, as will be explained later.

It should be noted that the dishwasher 10 has on the front side thereof, in addition to the relatively large access door 18, a removable service panel 50 located below door 18. The lower end of the panel 50 is supported by outwardly extending members 52 as shown in FIGS. 1–3. The member 52 is secured to the front channel member 22. A sheet metal member 54 is disposed below the panel 50 and set back therefrom to define a toe kick area 56. It is into this area 56, as shown in FIGS. 1–3, that the lower end of portion 44 carrying the foot 46 protrudes when it is in its anti-tip position, as shown in FIGS. 2 and 3. The member 52 has an inner and outer portion with the portion 44 positioned therebetween to thereby limit lateral movement of portion 44. It should be noted that the above-cited U.S. Pat. No. 3,738,727-Race et al, over which this invention is an improvement, discloses means for preventing tipping over of the cabinet when force is applied to a portion of the cabinet rather than to the door. The latching members in U.S. Pat. No. 3,378,727 that prevent tipping of the cabinet under these circumstances are located remote from the normal pivot of the anti-tip arm and, accordingly, the movement between the latching members is amplified. This requires that the movement between the anti-tip arm and the ridge or the cabinet be within certain tolerances to insure that they always engage each other in reaction to a cabinet tipping force. The present embodiment is an improvement over that disclosed in the above-mentioned Race et al patent. By the present invention, improved means are provided to prevent tipping over of the cabinet when a downward force is applied to the cabinet other than on the door. The latching members of the present embodiment are located adjacent the normal pivot of the anti-tip arm and, accordingly, movement therebetween is minimal. In the present system, the engaging parts between the cabinet and anti-tip structure, because of their close proximity to the normal pivot of the anti-tip arm, are self-aligning as assembled and automatically engage in response to an incident of cabinet tipping through movement of the cabinet, to prevent cabinet tilting.

Referring more particularly to FIGS. 4 and 5, there is shown formed on the portion 32 adjacent the surface 40 a locking lug 60. The lug 60 as provided is spaced from the surface of stop arm 40 to form a hook-like projection that provides a holding area or space 62 between the surface of stop arm 40 and the locking lug 60. The locking lug 60 and holding area 62 operate in combination with a latching portion 64 formed by the lower edge indexing member 42. The dimension and location of latching portion 64 of indexing member 42 relative to locking lug 60 is such that the latch portion 64 automatically enters area 62 behind lug 60 when a tilting force is exerted at some point on the cabinet other than on the open door, as shown in FIG. 3. With the door open, the latching portion 64 is substantially in vertical alignment with the holding area 62 as shown in FIGs. 2 and 4. FIG. 4 shows the latching structure positioned with the door open, and any downward force applied to the door would, through engagement of the surface 40 with the indexing member 42, force foot 46 against the floor surface and prevent further movement of the cabinet. In this position, tipping of the cabinet by a force other than on the door will cause foot 46 to make contact with the floor surface and drive the anti-tip portion 44 of member 30 upwardly. This upward movement of portion 44 will raise arm 32, causing the latching portion 64 to automatically enter holding area 62, as shown in FIGS. 3 and 5. In this locked position, with latch portion 64 against the lug 60, the contact between foot 46 and the floor surface becomes the pivot, and further tipping of the cabinet is substantially prevented.

In operation with the arrangement heretofore described, as the door 18 is opened the arm 32 moves outwardly from the position shown in FIG. 1 until the surface of stop arm 40 strikes the surface of indexing member 42 on the cabinet. This contact halts movement of the arm 32 and, accordingly, the door 18, as shown in FIG. 2. The outward sliding movement of the arm 32 causes the anti-tip arm 44 to also move from the retracted position shown in FIG. 1 to the tip-preventing position shown in FIGS. 2 and 4 wherein the foot 46 is forward of the cabinet. It should be noted that although the anti-tip arm 44 is in a tip-preventing position when the door 18 is opened, there is no actual locking engagement between the anti-tip arm and the cabinet, inasmuch as the lug 60 of the anti-tip arm 44 is disposed adjacent to the latching portion 64 but is not in contact therewith with the normal opening of the door 18, as shown in FIG. 2. However, the arrangement is such that any forward tilting of the cabinet, as would be caused by pushing downwardly or placing an extra heavy load on the outer end of the outwardly extending upper rack, will cause the lug 60 to automatically engage lower edge portion 64 of indexing member 42. With its engagement by lug 60, the portion 64 will enter and be locked in the space 62 by the lug 60. Engagement of the foot 46 of the arm portion 44 against the floor surface prevents further forward tilting or forward upsetting of the cabinet. The lug 60 and latching portion 64 act cooperatively to function as a locking means to lock the arm 32 in its extended position, as an incident of initially tilting the cabinet forwardly, to prevent upsetting the cabinet. FIG. 5 shows the latching structure positioned when a downward force is applied to the extended upper rack or the tilting forward of the cabinet. Removal of the tilting force from the upper rack or other cabinet portion will permit the cabinet to assume its full upright position whereby the locking means is released automatically by the edge portion 64 moving out of engagement with the lug 60. Thereafter, the closing of the door 18 from its open position shown in FIG. 2 to its closed position shown in FIG. 1 will retract the anti-tip arm 30 so that it is fully within the cabinet structure and hidden from view.

It should be apparent to those skilled in the art that the embodiment described heretofore is considered to be the presently preferred form of this invention. In accordance with the Patent Statutes, changes may be made in the disclosed apparatus and the manner in which it is used without actually departing from the true spirit and scope of this invention.

What is claimed is:

1. A freestanding cabinet adapted to be self-supporting on a floor surface having an access opening and an access door hinged about a horizontal axis for movement between a closed position and a fully open position where it is supported in a substantially horizontal position by a support means, said support means comprising:

an anti-tip member carried by said cabinet for allowing movement of said member from a retracted position to a tip-preventing position extending from the front of said cabinet in the door open position to a location adjacent said floor surface and outward of said cabinet;

a stop arm formed integral with said anti-tip member having an end connected to said access door for moving said anti-tip member between said retracted and extended tip-preventing position; and a leg portion engaging said floor when said anti-tip member is in its tip-preventing position;

means on said stop arm of said member including a stop surface area oriented perpendicular to the line of travel of said stop arm engaging a mating indexing surface secured relative to said cabinet at a location above said horizontal axis for positioning said door in its horizontal open position and to prevent tipping of said cabinet, in response to an incident of downward force on said door, tending to move said door downwardly from said open position; and locking means on said stop arm adjacent said stop surface area being dimensioned to automatically engage holding means on said indexing surface on said cabinet when said leg portion is in engagement with said floor to prevent tipping of said cabinet in response to an incident of downward force on a part of said cabinet apart from said door, tending to tip said cabinet, and for automatically releasing said locking means from said holding means on said indexing surface when such downward force is removed.

2. The invention recited in claim 1 wherein the locking means on said stop arm further includes a lug means dimensioned to engage a latching portion formed by the lower portion of said indexing surface to lock said anti-tip member in its tip-preventing position.

* * * * *